US007600291B2

(12) United States Patent
Choi

(10) Patent No.: US 7,600,291 B2
(45) **Date of Patent: *Oct. 13, 2009**

(54) MAIN BODY MOUNTING STRUCTURE OF UPRIGHT TYPE VACUUM CLEANER CAPABLE OF BEING CONVERTED TO CANISTER TYPE

(75) Inventor: Im Suk Choi, Incheon-si (KR)

(73) Assignee: Ace Electronics Co., Ltd., Yongin-si (KR)

( * ) Notice: Subject to any disclaimer, the term of this patent is extended or adjusted under 35 U.S.C. 154(b) by 434 days.

This patent is subject to a terminal disclaimer.

(21) Appl. No.: 11/505,298

(22) Filed: Aug. 17, 2006

(65) Prior Publication Data

US 2007/0039120 A1 Feb. 22, 2007

(30) Foreign Application Priority Data

Aug. 18, 2005 (KR) ..... 10-2005-0075741

(51) Int. Cl.
*A47L 5/30* (2006.01)

(52) U.S. Cl. ..... 15/329; 15/330; 15/334; 15/327.5

(58) Field of Classification Search ..... 15/320, 15/321, 327.5, 328–330, 334; *A47L 5/30*
See application file for complete search history.

(56) References Cited

U.S. PATENT DOCUMENTS

| | | | | |
|---|---|---|---|---|
| 5,309,600 | A | 5/1994 | Weaver et al. | |
| 5,524,321 | A | 6/1996 | Weaver et al. | |
| 5,715,566 | A | 2/1998 | Weaver et al. | |
| 6,961,975 | B2 * | 11/2005 | Park et al. | 15/329 |

* cited by examiner

*Primary Examiner*—David A Redding
(74) *Attorney, Agent, or Firm*—The Nath Law Group; Jerald L. Meyer; Sung Yeop Chung

(57) ABSTRACT

Disclosed herein is a main body mounting structure of an upright type vacuum cleaner capable of being converted to a canister type. The mounting structure comprises a main body having a suction port and a discharge port formed thereon and including a suction device inside the suction port, a connection panel on which the main body is detachably installed, a suction unit having a dust collecting port and a discharge opening and on which the connection panel is rotatably installed, an attaching mechanism disposed between the main body and the connection panel, an extension pipe and a handle detachably installed to the main body and having a hollow inner space to define a flow passage along which foreign substances are induced, and a suction hose connected at one end with the suction port and selectively connected at the other end with the discharge opening or the handle.

8 Claims, 7 Drawing Sheets

MAIN BODY MOUNTING STRUCTURE OF UPRIGHT TYPE VACUUM CLEANER CAPABLE OF BEING CONVERTED TO CANISTER TYPE

BACKGROUND OF THE INVENTION

1. Field of the Invention

The present invention relates to an upright type vacuum cleaner, and, more particularly, to a main body mounting structure of an upright type vacuum cleaner capable of being converted to a canister type vacuum cleaner, which enables a main body of the vacuum cleaner to be detachably mounted to a suction unit, allowing conversion of the vacuum cleaner from an upright type to a canister type or vice versa, and comprises an attaching mechanism serving to restrict vertical and horizontal movements of the main body simultaneously, whereby the vacuum cleaner can be stably mounted on and easily detached from the suction unit.

2. Description of the Related Art

A vacuum cleaner is a household appliance which sucks dust and other foreign substances scattered on floors, walls, small gaps and the like in a room via a strong suction force from a negative pressure generated by driving a fan motor and operating a vacuum pump, and then collects the dust and the other foreign substances using a dust collecting filter positioned therein.

According to shapes and using postures, the vacuum cleaners can be classified into a canister type vacuum cleaner, which provides convenience in corner cleaning and movement while allowing easy replacement of a brush and a nozzle, and an upright type vacuum cleaner, which provides convenience in maintenance and allows easy cleaning of a large space.

FIG. 1 is a perspective view illustrating a conventional upright type vacuum cleaner.

The conventional upright type vacuum cleaner comprises a suction unit 100 having wheels 105 attached to a lower surface thereof and serving to suck dust on a floor, a main body 200 having components such as motor and the like contained therein, and an upright type handle 300.

For the upright type vacuum cleaner constructed as above, the suction unit 100 is formed at the lower surface with a suction port (not shown) to which a brush is attached and through which dust removed by the brush is sucked into the suction unit. Then, the sucked dust flows along with air and is collected via a filter, while the air is discharged to the outside.

The conventional upright type vacuum cleaner has a merit in that, since the suction unit has a wider area than an associated portion of the main body to allow the vacuum cleaner to stand upright thereon, the conventional upright type vacuum cleaner is able to clean a wider area in a room while moving thereon, and can be maintained in an upright state after finishing the cleaning operation.

However, for the conventional upright type vacuum cleaner, since it is necessary to perform the cleaning operation with the suction unit facing a floor, it is difficult to perform the cleaning operation of narrow spaces such as corners or gaps between pieces of furniture.

In addition, since the main body 200 has a relatively heavy weight and is maintained in the upright state by the suction unit 100, it is difficult to clean or replace a roller and a filter which are installed to a suction port through which the foreign substances are induced.

SUMMARY OF THE INVENTION

Therefore, the present invention has been made in view of the above problems of the conventional vacuum cleaner, and it is an object of the present invention to provide a main body mounting structure of an upright type vacuum cleaner capable of being converted to a canister type vacuum cleaner, which enables a main body of the vacuum cleaner to be detachably mounted to a suction unit, thereby allowing easy conversion of the vacuum, cleaner from the upright type to the canister type or vice versa.

It is another object of the present invention to provide the main body mounting structure of the upright type vacuum cleaner capable of being converted to the canister type, which comprises an attaching mechanism serving to restrict vertical and horizontal movements of the main body, so that, even when the main body is slanted a predetermined angle from the suction unit for easy cleaning operation, the main body is prevented from being detached from the suction unit.

In accordance with an aspect of the present invention, the above and other objects can be accomplished by the provision of a main body mounting structure of an upright type vacuum cleaner capable of being converted to a canister type vacuum cleaner, comprising: a main body having a suction port and a discharge port formed thereon, and including a suction device inside the suction port; a connection panel on which the main body is detachably installed; a suction unit having a dust collecting port and a discharge opening, and on which the connection panel is installed in a freely attachable and detachable manner; an attaching mechanism disposed between the main body and the connection panel; an extension pipe and a handle detachably installed to the main body, and having a hollow inner space to define a flow passage along which foreign substances are induced; and a suction hose connected at one end with the suction port, and selectively connected at the other end with the discharge opening or the handle.

Preferably, the main body is formed with a plurality of latch grooves at a lower surface thereof corresponding to the attaching mechanism.

Preferably, the connection panel comprises an upper panel on which the main body is installed, a lower panel coupled to a bottom surface of the upper panel, and a securing panel fastened to the suction unit, the attaching mechanism installed between the upper panel and the lower panel such that the attaching mechanism is fastened to the latch grooves.

Preferably, the upper panel is formed with covers, each having an upper portion protruding so as to correspond to an associated latch groove and a lower portion opened to allow the attaching mechanism to enter or exit the cover therethrough.

Preferably, the attaching mechanism comprises: a hook assembly rotatably installed between the upper panel and the lower panel, and having a plurality of latch hooks disposed to protrude outside the upper panel; a spring interposed between the hook assembly and the lower panel; a knob installed to the upper panel such that the knob slides perpendicularly and causes the hook assembly to rotate by manipulation of a user; a plurality of protrusions formed under a lower surface of the main body; and a plurality of grooves formed on the upper panel corresponding to the protrusions.

Preferably, the hook assembly comprises a first latch hook member formed at a central portion of the upper panel, and a second latch hook member coupled to the first latch hook member to rotate simultaneously with the first latch hook member.

Preferably, the second latch hook member comprises a pair of latch hooks integrally formed with a rotational shaft of the second latch hook member, an extension part extending forwardly from the rotational shaft, and a hole formed on the extension part such that the first latch hook member is inserted into the hole.

Preferably, the knob is installed on the upper panel to slide perpendicularly thereon, and comprises a pair of pushing parts corresponding to the hole and a front end of the first latch hook member.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Preferred embodiments of the present invention will be described in detail with reference to the accompanying drawings as follows.

Figure 1:
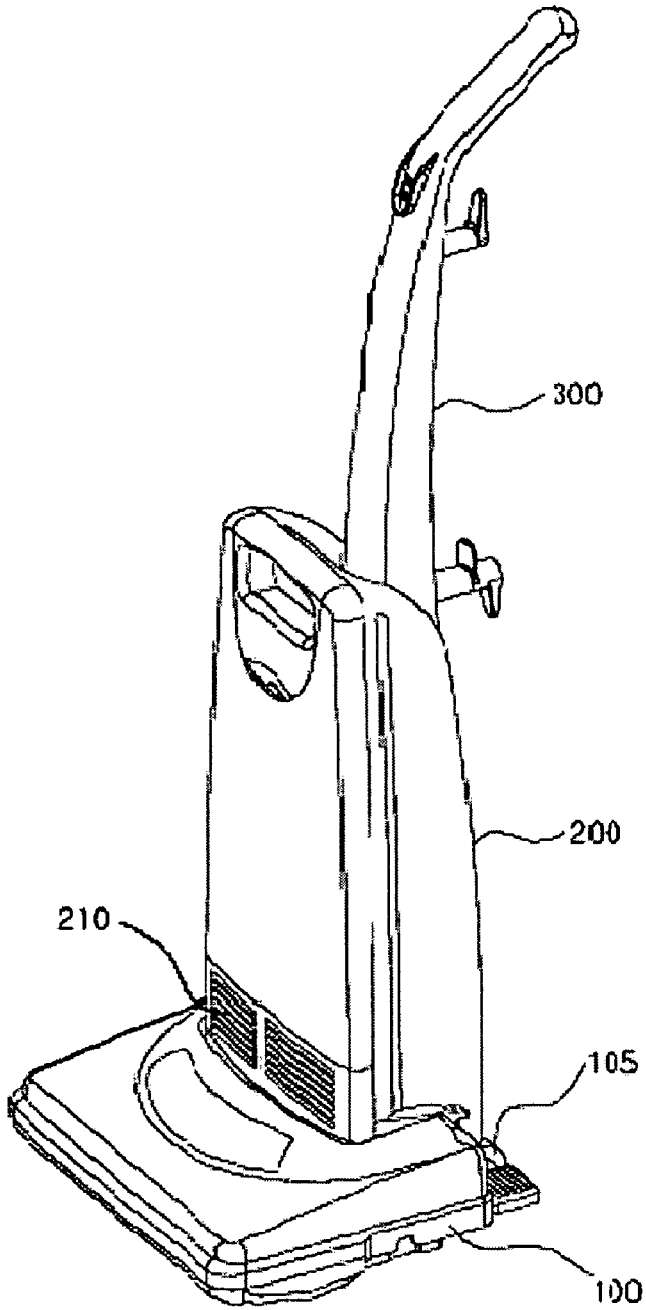
FIG. 1 (Prior Art)
FIG. 1 is a perspective view illustrating a conventional upright type vacuum cleaner.
Figure 2:
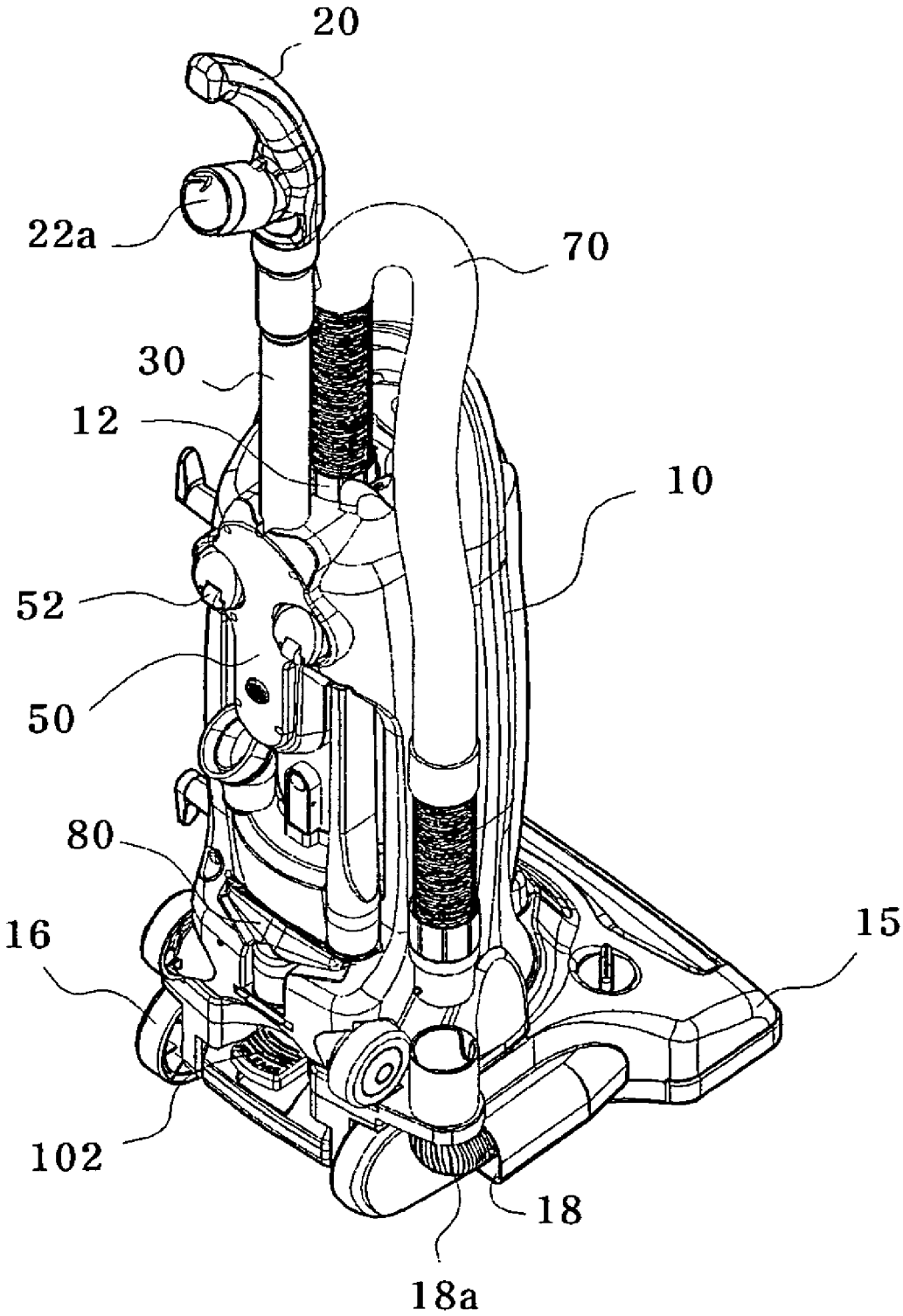
FIG. 2 is a rear perspective view illustrating a vacuum cleaner according to the present invention.
Figure 3:
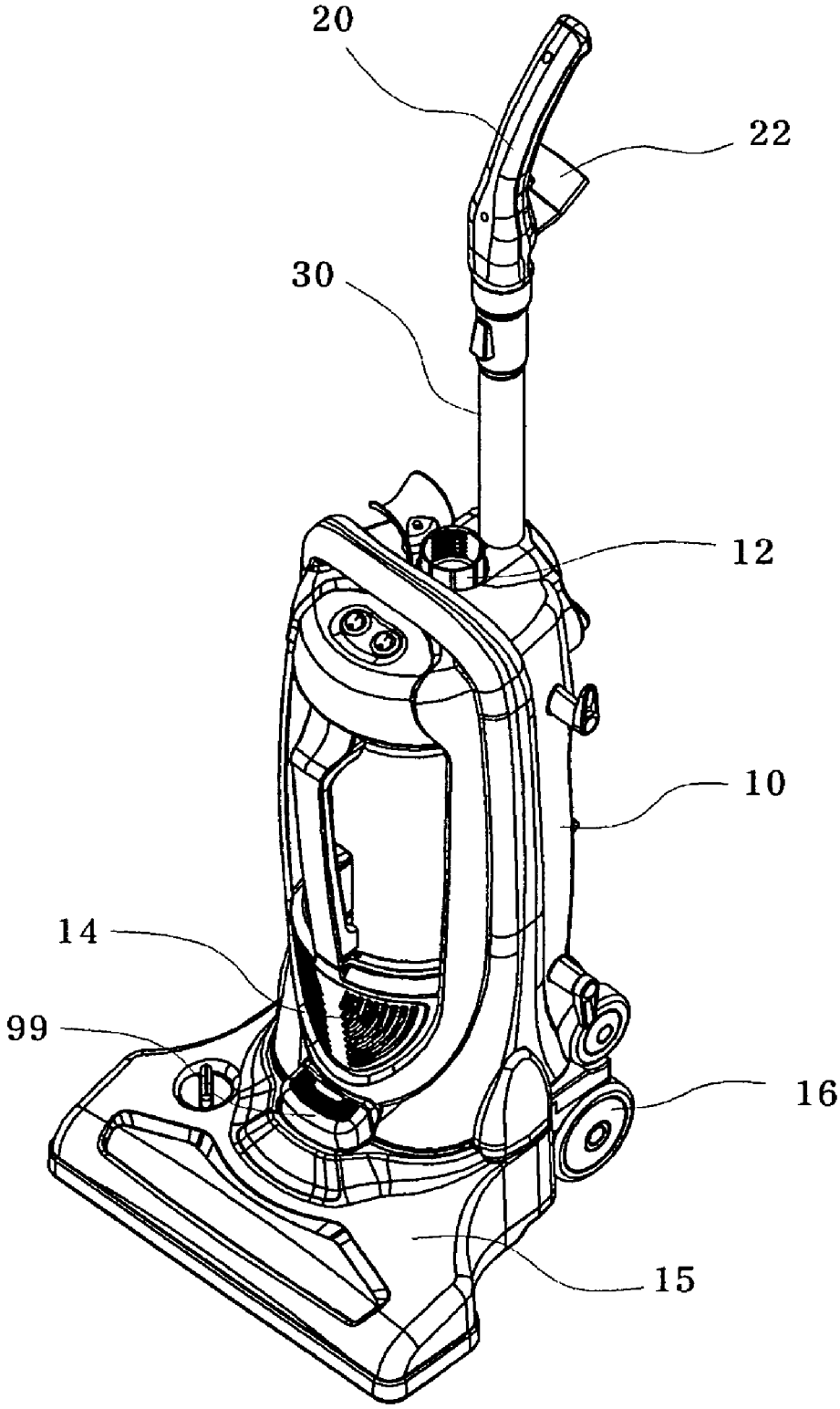
FIG. 3 is a front perspective view illustrating the vacuum cleaner according to the present invention.

FIG. 2 is a rear perspective view illustrating a vacuum cleaner according to the present invention, and FIG. 3 is a front perspective view illustrating the vacuum cleaner according to the present invention.

An upright type vacuum cleaner according to the present invention can be converted into a canister type vacuum cleaner, and comprises: a main body 10 having a suction port 12 and a discharge port 14 formed thereon and being installed with a suction device inside the suction port 12; a connection panel 60 on which the main body 10 is detachably installed; a suction unit 15 having a dust collecting port and a discharge opening 18 and on which the connection panel is rotatably installed; an attaching mechanism 90 disposed between the main body 10 and the connection panel 60; an extension pipe 30 and a handle 20 detachably installed to the main body 10 and having a hollow inner space to define a flow passage along which foreign substances are induced; and a suction hose 70 connected at one end with the suction port 12 and selectively connected at the other end with the discharge opening 18 or the handle 20.

Figure 5:
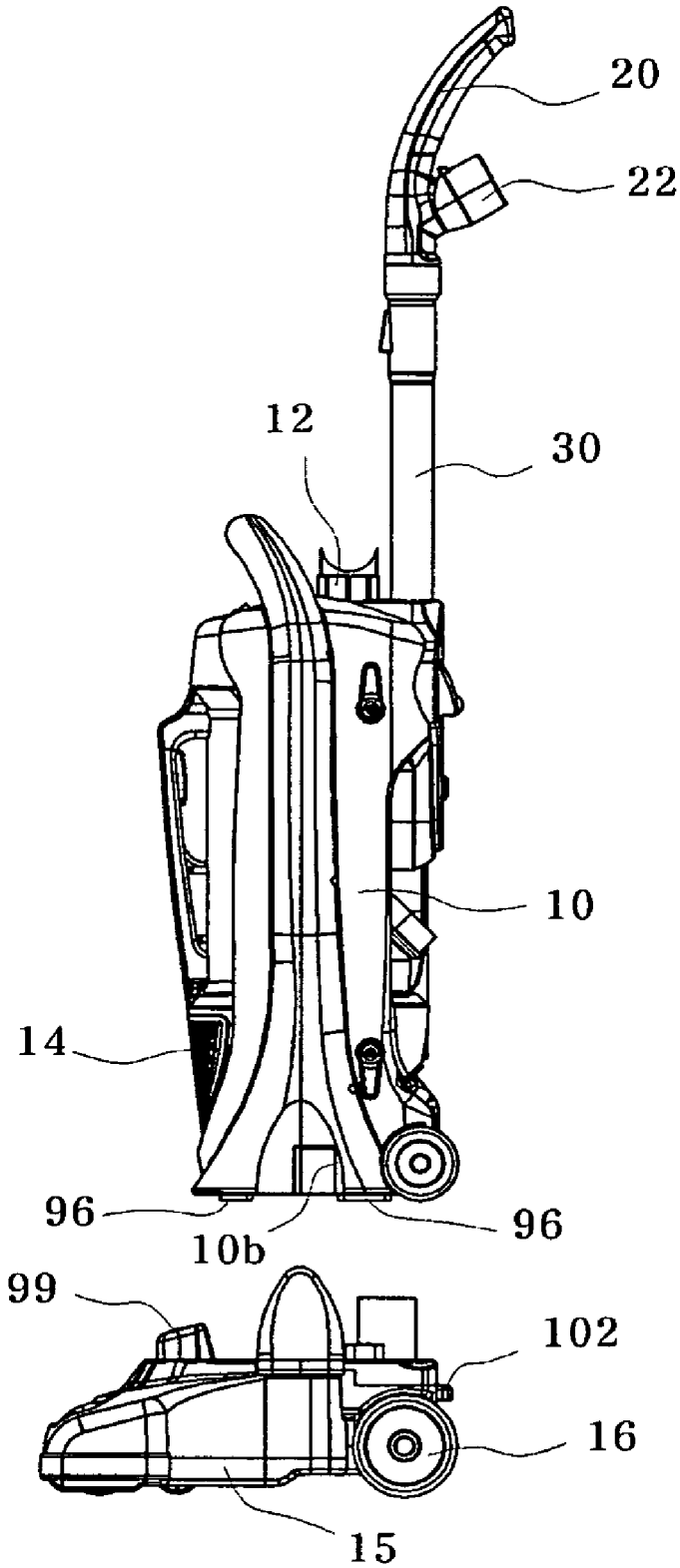
FIG. 5 is a side view illustrating the main body mounting structure according to the present invention.

When the suction hose 70 is fitted into the discharge opening 18 with the main body 10 seated on an upper surface of the suction unit 15, the vacuum cleaner becomes the upright type in which foreign substances and air suctioned through the dust collecting port of the suction unit 15 flow into the main body 10 through the suction port 12 via the discharge opening 18 and the suction hose 70. On the other hand, when the suction hose 70 is separated from the discharge opening 18 and coupled to the handle 20 with the main body 10 detached from the suction unit 15, the vacuum cleaner becomes the canister type, as shown in FIG. 5, in which the foreign substances and air flow along a suction passage extending from the extension pipe 30 to the main body 10 via the handle 20.

Referring to FIG. 2, the main body 10 has a vertically elongated space defined therein to receive a dust container and the suction device. The main body 10 has the suction port 12 formed at an upper surface, and the discharge port 14 formed at a front lower portion.

The suction unit 15 has a lower part wider than the main body 10 such that, when the main body 10 is coupled to the upper surface of the suction unit 15, it can stand upright. The dust collecting port is formed at a bottom surface of the suction unit 15, and the discharge opening 18 is formed at one side of an upper portion thereof such that the induced foreign substances and air are discharged therethrough. Thus, when the main body 10 is coupled to the upper surface of the suction unit 15, the vacuum cleaner becomes the upright type in which the foreign substances and air induced through the dust collecting port are suctioned into the main body 10 via the discharge opening 18 and the suction hose 70.

The main body 10 is formed with a plurality of latch grooves 10*a* and 10*b* at a lower surface thereof corresponding to the attaching mechanism 90 such that, when the main body 10 is seated on the connection panel 60, a hook assembly 92 described below is rotated to allow latch hooks of the hook assembly 92 to be latched to the latch grooves 10*a* and 10*b*, thereby restricting a vertical movement of the main body 10.

The connection panel 60 comprises an upper panel 62 on which the main body 10 is installed, a lower panel 63 coupled to a bottom surface of the upper panel 62 and provided with wheels 16 such that the wheels 16 protrude below the bottom surface of the suction unit 15, and a securing panel 61 fastened to the suction unit 15 while rotatably restricting a rotational shaft of the wheels 16, in which the attaching mechanism 90 is installed between the upper panel 62 and the lower panel 63 such that components of the attaching mechanism 90 are fastened to the latch grooves 10*a* and 10*b*.

Figure 4:
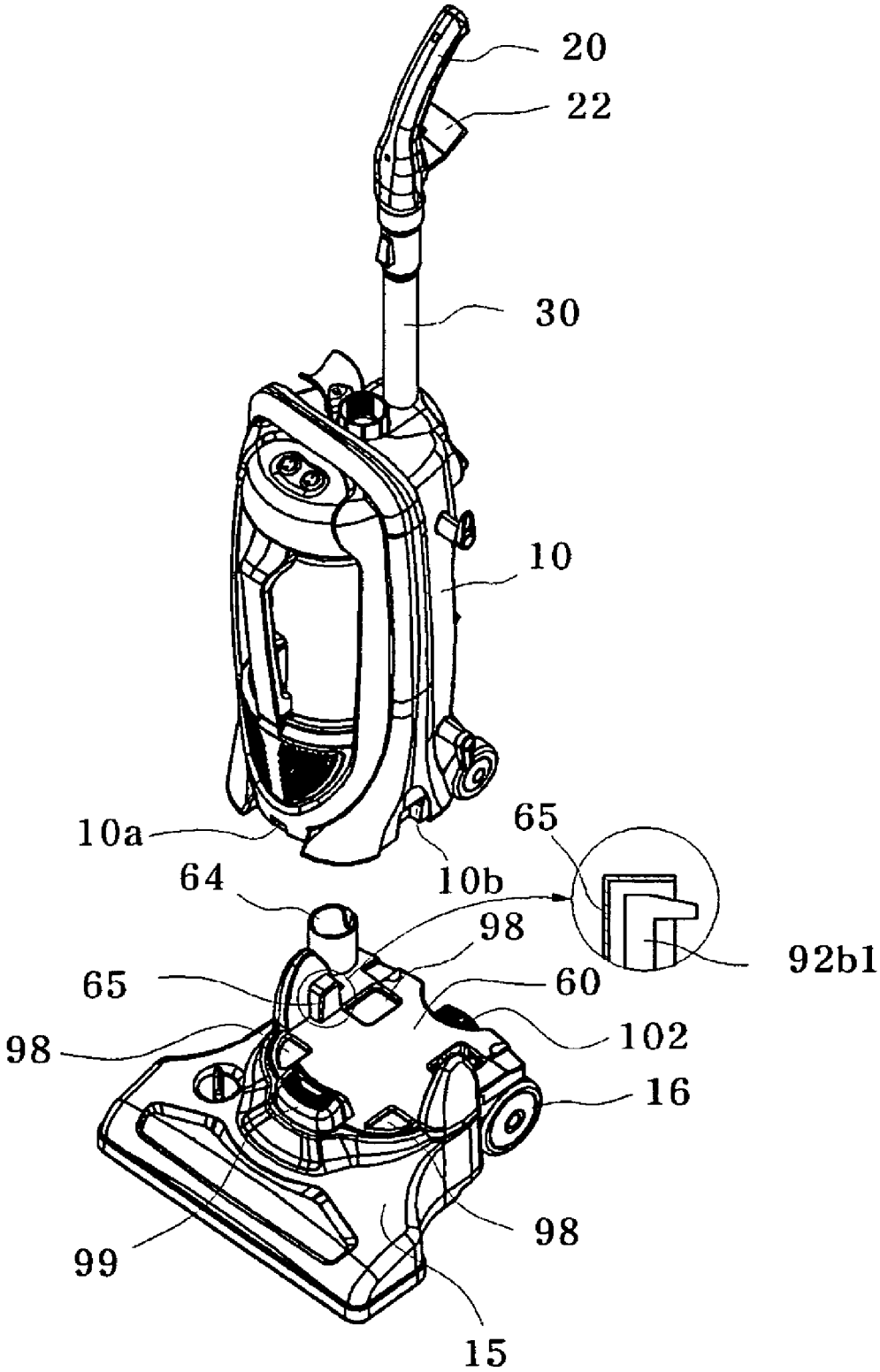
FIG. 4 is an exploded perspective view illustrating a main body mounting structure according to the present invention.

As shown in FIG. 4, the upper panel 62 is formed with covers 65, each of which has an upper portion protruding so as to correspond to an associated latch groove 10*a* or 10*b*, and a lower portion opened to allow the components of the attaching mechanism to enter or exit the cover therethrough. With this structure, when manipulating the knob 99 to rotate the hook assembly 92, the latch hooks of the hook assembly 92 enter the covers 65 through the lower portions thereof, and are latched to the latch grooves 10*a* and 10*b*, thereby restricting the vertical movement of the main body 10.

Figure 6:
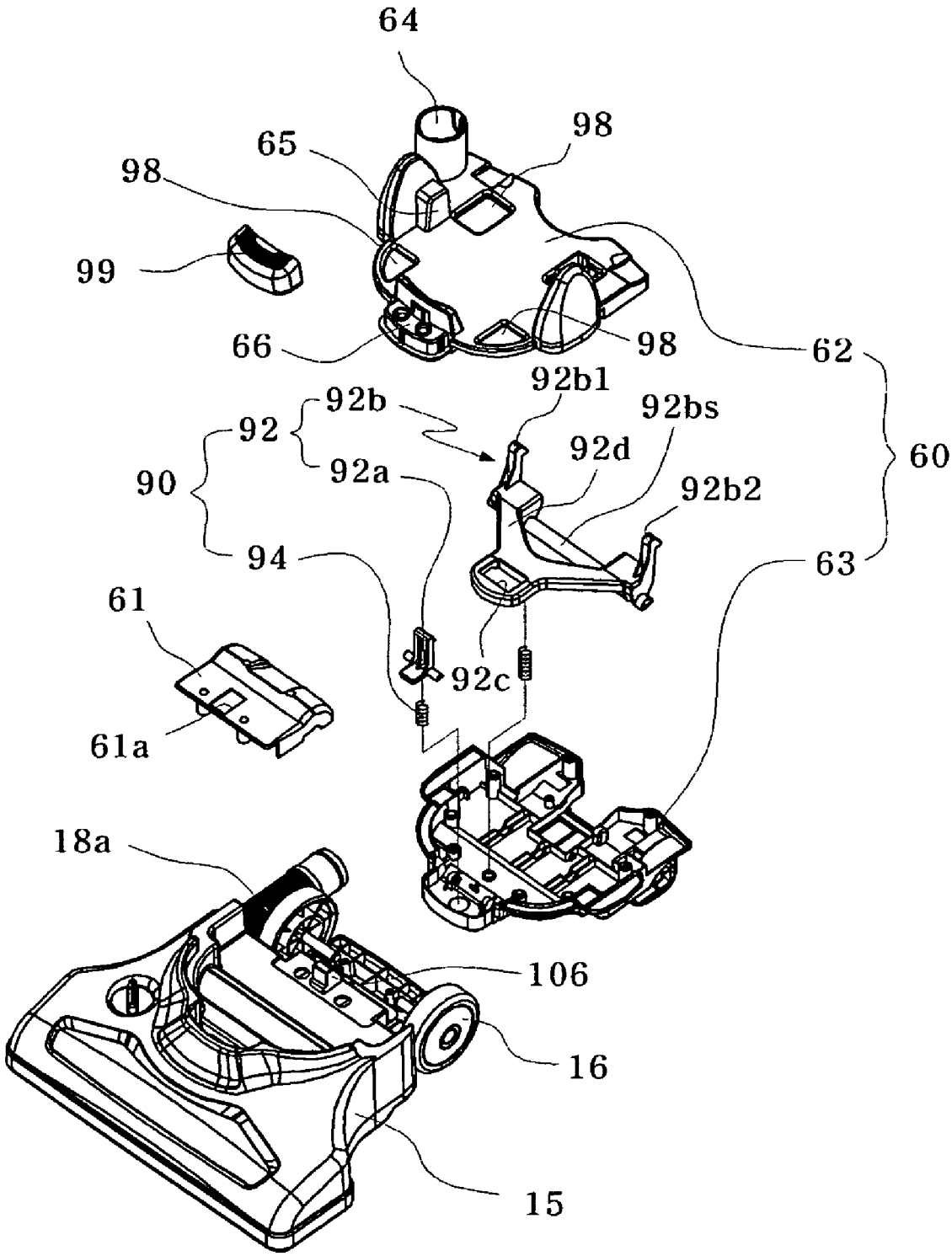
FIG. 6 is an exploded perspective view illustrating an attaching mechanism of the vacuum cleaner according to the present invention.
Figure 7:
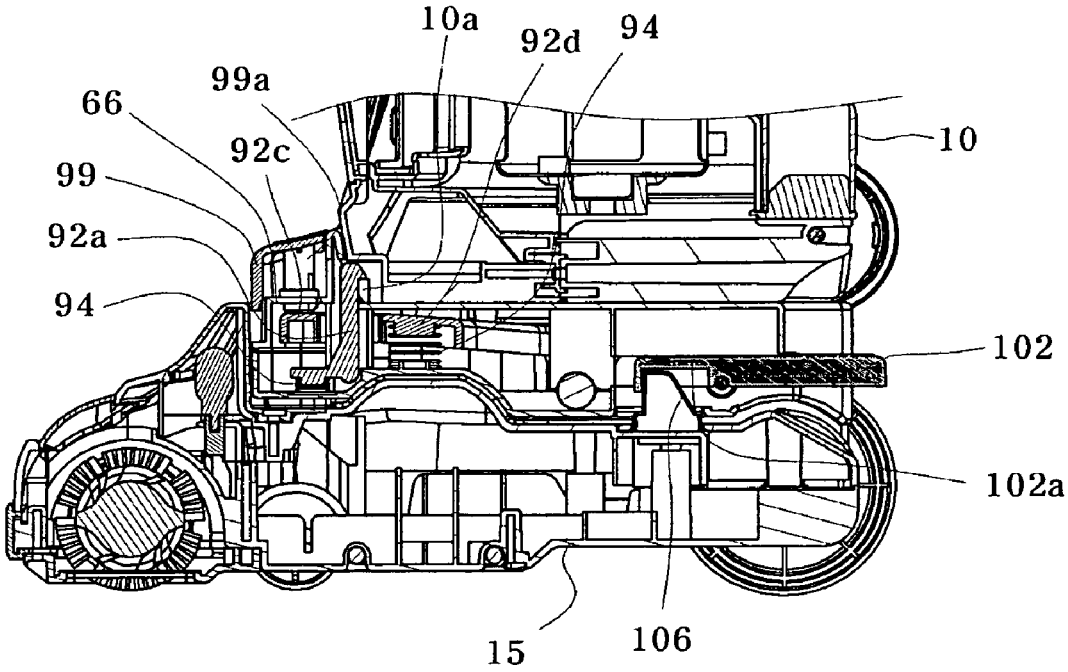
FIG. 7 is a cross-sectional view illustrating attaching mechanism of the vacuum cleaner according to the present invention.

FIG. 6 is an exploded perspective view illustrating the attaching mechanism of the vacuum cleaner according to the present invention, and FIG. 7 is a cross-sectional view illustrating the attaching mechanism of the vacuum cleaner according to the present invention.

The attaching mechanism 90 comprises the hook assembly 92 rotatably installed between the upper panel 62 and the lower panel 63, and having the plurality of latch hooks disposed to protrude outside the upper panel 62, a spring 94 interposed between the hook assembly 92 and the lower panel 63, the knob 99 installed to the upper panel 62 to slide perpendicularly and cause the hook assembly 92 to rotate by manipulation of a user, a plurality of protrusions 96 formed under the lower surface of the main body 10, and a plurality of grooves 98 formed on the upper panel 62 corresponding to the protrusions 96.

The hook assembly 92 comprises a first latch hook member 92*a* installed at a central portion of the upper panel 62, and a second latch hook member 92*b* coupled to the first latch hook member 92 to rotate simultaneously with the first latch hook member 92*a*. The second latch hook member 92*b* comprises a pair of latch hooks 92*b*1 and 92*b*2 integrally formed with a rotational shaft 92*bs* of the second latch hook member 92*b*, an extension part 92*d* extending forwardly from the rotational shaft 92*bs*, and a hole 92*c* formed on the extension part 92*d* such that the first latch hook member 92*a* is inserted into the hole 92*c*. With this structure, when handling the knob 99 so as to compress the hole 92*c*, the spring 92 is also compressed, allowing the first and second latch hook members 92*a* and 92*b* to be rotated. Then, the first latch hook member 92*a* is separated from the latch groove 10*a*, and the second latch hook member 92*b* is separated from the latch groove 10*b* while being rotated inwards. As a result, the main body 10 is separated from the suction unit 15.

The knob 99 is installed to the upper panel 62 to slide perpendicularly thereon, and comprises a pair of pushing parts 99*a* corresponding to the hole 92*c* and a front end of the first latch hook member 92*a*. Thus, when compressing the knob 99, the hole 92*c* and the front end of the first latch hook member 92*a* are forced to rotate in the counterclockwise direction on the cross-sectional view of FIG. 7 so that the first latch hook member 92*a* and the second latch hook member 92*b* are released from the latch grooves 10*a* and 10*b*, thereby allowing the main body 10 to be separated from the suction unit 15.

Operation of the main body mounting structure of the upright type vacuum cleaner capable of being converted to the canister type according to the present invention will be described hereinafter.

Since the extension pipe 30 having the handle 20 attached thereto can be detachably installed to the main body 10, the extension pipe 30 is installed to the main body 10 by a rear cover 50 as shown in FIG. 2 when the vacuum cleaner is used as the upright type. Thus, a user can perform a cleaning operation while moving the main body 10 via the wheels 16 installed to the suction unit 15 with the handle 20.

When stepping on the lever 102, the connection panel 60 is detached from the suction unit 15, allowing the main body 10 to be rotatably moved. Thus, the main body 10 can be easily pushed or pulled, thereby allowing the cleaning operation to be easily performed.

In addition, the vacuum cleaner can be converted from the upright type to the canister type as follows. First, the extension pipe 30 is separated from the main body 10 by manipulating a button on the rear cover 50 attached to the rear side of the main body 10. Then, the suction pipe 70 is detached from the discharge opening 18, and inserted into a fastening hole 22*a* of a handle body 22. Finally, the main body 10 is separated from the suction unit 15, and laid on a floor, thereby constituting the canister type vacuum cleaner. In this state, a suction head 80 is provided to a lower end of the extension pipe 30, thereby enabling an easy cleaning operation of narrow spaces such as a gap between pieces of furniture.

As such, when pushing the knob 99, the pushing parts 99*a* of the knob 99 are inserted into the connection panel 60 through a seating hole 66, and compress the hole 92*c* and the front end of the first latch hook member 92*a* downwardly, forcing the hook assembly 92 to rotate while compressing the spring 92. Then, the first and second latch hook members 92*a* and 92*b* are rotated in the counterclockwise direction, and separated from the latch grooves 10*a* and 10*b* of the main body 10, causing the main body 10 to be separated from the suction unit 15.

With the structure and operation as described above, the vacuum cleaner can be easily converted from the upright type to the canister type or vice versa, and enables easy mounting and detachment of the main body.

According to the present invention, the main body and the suction unit of the vacuum cleaner are separately manufactured, and detachably coupled to each other by means of the connection panel, whereby the vacuum cleaner can be used as the canister type or the upright type according to selection of installation of the main body and the suction hose with respect to the suction unit by manipulation of a user, thereby providing advantageous effects in that, when cleaning a wide area, the vacuum cleaner is used as the upright type, enabling an easy cleaning operation of the wide area, and when suctioning foreign substances accumulated in a narrow space or a gap, the vacuum cleaner is used as the canister type, enabling a convenient cleaning operation thereof.

In addition, the main body mounting structure of the present invention comprises the latch hooks and the latch grooves to restrict vertical movement of the main body, and the protrusions and the grooves to restrict horizontal movement of the main body between the main body and the connection panel, so that, when using the vacuum cleaner as the upright type, the main body is stably mounted on the suction unit, allowing the easy cleaning operation of the wide area, and when converting the upright type vacuum cleaner to the canister type, the main body can be easily detached from the suction unit by a simple operation of pushing the knob, thereby reducing consumption of time required to convert the vacuum cleaner from the upright type to the canister type. Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A main body mounting structure of an upright type vacuum cleaner capable of being converted to a canister type vacuum cleaner, comprising:

a main body having a suction port and a discharge port formed thereon, and including a suction device inside the suction port;

a connection panel on which the main body is detachably installed;

a suction unit having a dust collecting port and a discharge opening and on which the connection panel is installed in a freely attachable and detachable manner;

an attaching mechanism disposed between the main body and the connection panel;

an extension pipe and a handle detachably installed to the main body and having a hollow inner space to define a flow passage along which foreign substances are induced; and a suction hose connected at one end with the suction port, and selectively connected at the other end with the discharge opening or the handle.

2. The main body mounting structure according to claim 1, wherein the main body is formed with a plurality of latch grooves at a lower surface corresponding to the attaching mechanism.

3. The main body mounting structure according to claim 2, wherein the connection panel comprises an upper panel on which the main body is installed, a lower panel coupled to a bottom surface of the upper panel, and a securing panel fastened to the suction unit, the attaching mechanism being installed between the upper panel and the lower panel such that the attaching mechanism is fastened to the latch grooves.

4. The main body mounting structure according to claim 3, wherein the upper panel is formed with covers, each having an upper portion protruding so as to correspond to an associated latch groove, and a lower portion opened to allow the attaching mechanism to enter or exit the cover therethrough.

5. The main body mounting structure according to claim 3, wherein the attaching mechanism comprises:

a hook assembly rotatably installed between the upper panel and the lower panel, and having a plurality of latch hooks disposed to protrude outside the upper panel;

a spring interposed between the hook assembly and the lower panel;

a knob installed to the upper panel such that the knob slides perpendicularly and causes the hook assembly to rotate by manipulation of a user;

a plurality of protrusions formed under a lower surface of the main body; and a plurality of grooves formed on the upper panel corresponding to the protrusions.

6. The main body mounting structure according to claim 5, wherein the hook assembly comprises a first latch hook member formed at a central portion of the upper panel, and a second latch hook member coupled to the first latch hook member to rotate simultaneously with the first latch hook member.

7. The main body mounting structure according to claim 6, wherein the second latch hook member comprises a pair of latch hooks integrally formed with a rotational shaft of the second latch hook member, an extension part extending forwardly from the rotational shaft, and a hole formed on the extension part such that the first latch hook member is inserted into the hole.

8. The main body mounting structure according to claim 5, wherein the knob is installed on the upper panel to slide perpendicularly thereon, and comprises a pair of pushing parts corresponding to the hole and a front end of the first latch hook member.

* * * * *